United States Patent [19]

Sekiguchi

[11] Patent Number: 5,022,871

[45] Date of Patent: Jun. 11, 1991

[54] MULTIPOLAR CONNECTOR SOCKET

[75] Inventor: Shigemi Sekiguchi, Kiryu, Japan

[73] Assignee: Hosiden Corporation, Osaka, Japan

[21] Appl. No.: 617,216

[22] Filed: Nov. 23, 1990

[30] Foreign Application Priority Data

Nov. 29, 1989 [JP] Japan ..... 1-138923[U]
Mar. 16, 1990 [JP] Japan ..... 2-26819[U]

[51] Int. Cl.[5] ..... H01R 13/648
[52] U.S. Cl. ..... 439/609
[58] Field of Search ..... 439/607-610

[56] References Cited

U.S. PATENT DOCUMENTS 4,842,554 6/1989 Cosmos et al. ..... 439/609
4,983,127 1/1991 Kawai et al. ..... 439/609

*Primary Examiner*—Gary F. Paumen
*Attorney, Agent, or Firm*—Pollock, VandeSande and Priddy

[57] ABSTRACT

In a multipolar connector plug in which an annular recessed groove is formed in the front face of a square insulating body, and a plurality of contact-receiving holes are formed in the column portion defined inside the annular recessed groove and have female contacts received therein respectively, the front surface of the insulating body is covered with a front shield plate formed of a conductive spring material, and the insulating body is covered with a shield cover so that at least the top rear surfaces and both sides of the insulating body are covered. The front shield plate has a square plate portion having a concentrically made hole equal to or slightly larger than the annular recessed groove, and from the circumferential edge thereof, a plurality of tongue pieces are formed to extend rearward in the annular recessed groove. The front shield cover further includes a contact piece extending rearward from the upper edge of the plate portion along the top surface of the body and a pair of holding pieces extended from the upper and lower edge of the plate portion and bent to the top and bottom surfaces of the body. The contact piece is bent so that at least one of a valley and a crest is formed in the middle portion thereof, and sandwiched by the top plate portion of the shield cover and the top surface of the body to abut the shield cover with a strong elastic force, whereby the front shield plate and the shield cover are electrically connected to each other.

10 Claims, 11 Drawing Sheets

MULTIPOLAR CONNECTOR SOCKET

BACKGROUND OF THE INVENTION

This invention relates to a multipolar connector socket which is used for electrical connection between various apparatuses.

For instance, a multipolar connector socket covered with a shield cover was proposed, as described in the U.S. Pat. No. 4,842,554 specification. The shield cover of the multipolar connector socket with a shield cover described in this U.S. Patent specification is constructed, as shown in FIGS. 1 to 3, such that the shield cover has plate portions 21, 22, 23 and 24 covering the top surface, both sides and the front surface of insulating body 10, plate portions 21-24 of these four sides cover and shield the respective sides of insulating body 10 and circular hole 25 is formed in plate portion 24 covering the front, the circular hole having a diameter equal to the outer periphery of annular recessed groove 11, a plurality of tongue pieces 26 projecting in the central direction are formed on the edge of circular hole 25, and these tongue pieces are bent and inserted into annular recessed groove 11 to be electrically contacted with cylindrical metal cover 31 of plug 30 (FIG. 3).

FIGS. 4 and 5 show another embodiment of the prior art. This example shows a construction in which front shield plate 40 formed of a conductive spring material is mounted on the front of insulating body 10, and insulating body 10 to which the front shield cover 40 is attached is capped with shield cover 20.

That is, front shield plate 40 has circular hole 41 having a diameter substantially equal to the outer periphery of annular recessed groove 11 formed in the front of insulating body 10, and a plurality of tongue pieces 42 formed in the edge of the circular hole 41 and projecting toward the center thereof, and these tongue pieces 42 are bent and inserted into annular recessed groove 11 of insulating body 10. The upper and lower sides of front shield plate 40 are bent toward the top and bottom of insulating body 10 and engaged with insulating body 10.

Shield cover 20 has five plate portions for covering the front, top, and rear surfaces and both sides of the insulating body in this example, and circular hole 25 is formed in the front surface, whereby annular recessed groove 11 and the outer periphery of circular hole 41 of shield plate 40 are exposed. The bottom of shield cover 20 is open, and insulating body 10 is inserted from this open bottom. Holes are formed in the top of shield cover 20, through which holes front shield plate 40 and shield cover 20 are soldered to each other by solders HN, thereby electrically and mechanically integrating front shield plate 40 and shield cover 20.

According to the structure shown in FIGS. 1-3, since tongue pieces 26 are integrally formed and projecting from shield cover 20, it is required to form the whole shield cover 20 of a conductive spring material. For this, there is a disadvantage that the cost of shield cover 20 becomes high and shield cover 20 is easy to deform. In addition, according to the structure shown in FIGS. 1 and 2, there is also a drawback that the shield effect is low because the rear surface of insulating body 10 is not covered with shield cover 20.

On the other hand, according to the structure shown in FIGS. 4 and 5, the rigidity of shield cover 20 can be made large and tongue pieces 42 are made of front shield plate 40, it is only needed to form front shield plate 40 with a conductive spring material, and thus, there is an advantage that shield cover 20 can be made of an inexpensive material Contrary to this, however, work is required for soldering front shield plate 40 and shield cover 20, which produces a disadvantage that the manufacturing becomes troublesome

SUMMARY OF THE INVENTION

It is the object of this invention to provide a multipolar connector socket of such type the material cost of which is inexpensive and which is easy to manufacture.

In accordance with this invention, the front surface of an insulating body is covered with a front shield plate of a spring material, a plurality of tongue pieces are formed of the front shield plate, the plurality of tongue pieces are bent and inserted into the annular recessed groove formed in the insulating body, and a projecting contact piece is provided in the upper side of the front shield plate. The contact piece is bent toward the top of the insulating plate and its free end is spaced from the top of the insulating body, whereby it is held in an attitude of producing a repulsion force against the pressure from the upper portion. The contact piece is electrically contacted with the shield cover by the repulsion force produced by the free end, thereby obviating the necessity of soldering.

In accordance with this structure, the tongue pieces to be inserted into the annular recessed groove formed in the insulating body are formed of the front shield plate, and thus only the front shield plate need be formed of a conductive spring material. Consequently, the material cost can be made low. In addition, a projecting contact piece is provided in the upper side of the front shield plate and it is elastically contacted with the top of the shield cover, so that it is unnecessary to solder the front shield plate and the shield cover. Accordingly, a multipolar connector socket can be provided which is inexpensive and easy to manufacture.

DESCRIPTION OF THE PREFERRED EMBODIMENT

Figure 6:
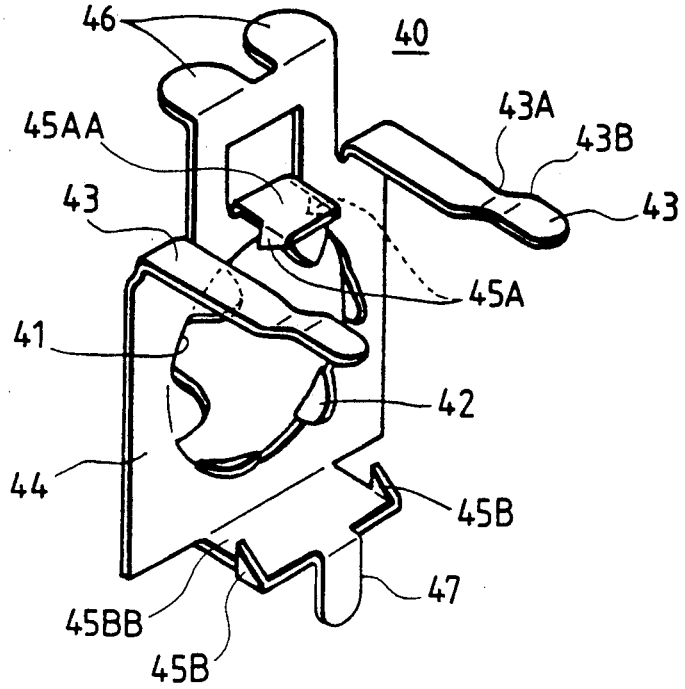
FIG. 6 is a perspective view for explaining the structure of the front shield plate which is the main portion of the multipolar connector socket of this invention.

FIG. 6 shows the structure of front shield plate 40 which is the main portion of the first embodiment of the multipolar connector socket of this invention. The characteristic structure of the connector socket of this invention is that there is provided at least one contact piece 43 rearwardly extending from the upper side of front shield plate 40 perpendicularly to plate portion 44 (in this example, two contact pieces 43 are provided). The contact piece 43 is bent so that a valley or crest is formed in at least one place in the intermediate portion, and in this embodiment, valley 43A is formed in substantially the center of contact piece 43 and crest 43B is formed in a further forward portion When the front shield plate 40 is attached to the front surface of body 10 and body 10 is further covered with shield cover 20, valley 43A of contact piece 43 is upwardly pressed by the upper surface of body 10 and crest 43B is downwardly pressed by the inner wall surface of the upper plate portion of shield cover 20, and contact piece 43 and the upper plate portion of the shield cover are thus elastically contacted with each other with a high pressure. Accordingly, front shield plate 40 and shield cover 20 can positively be electrically contacted with each other without soldering them.

Figure 7:
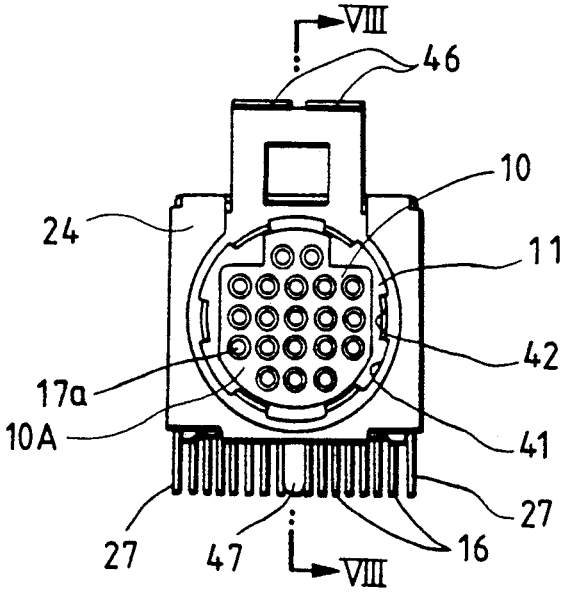
FIG. 7 is a front view showing an example of the multipolar connector socket which uses the front shield plate of FIG. 6.
Figure 8:
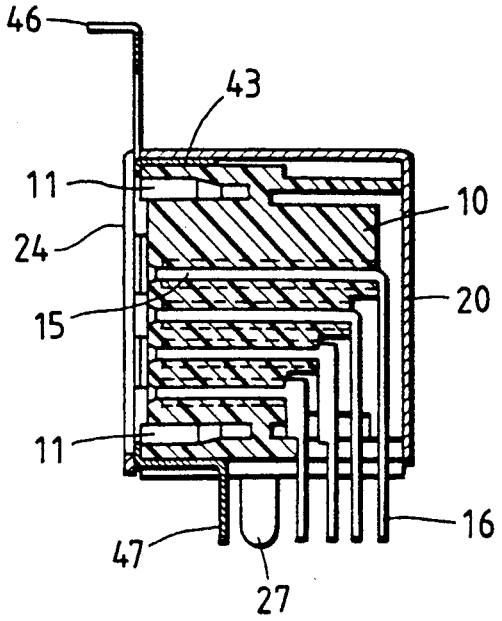
FIG. 8 is a sectional view on the VIII—VIII line shown in FIG. 7.
Figure 9:
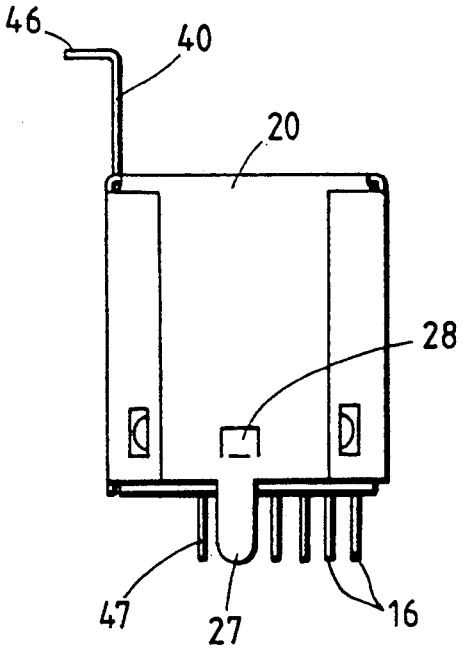
FIG. 9 is a side view of FIG. 7.
Figure 10:
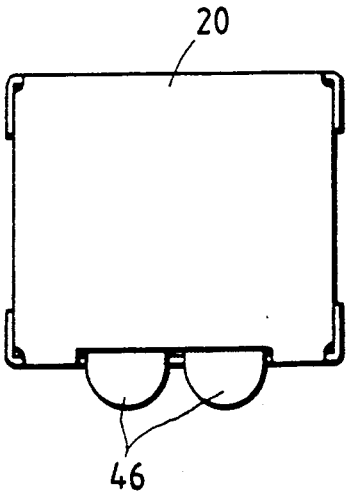
FIG. 10 is a plan view of FIG. 7.

Front shield plate 40 comprises substantially square plate portion 44 formed of a conductive spring material and covering the front of insulating body 10, the above described contact piece 43, circular hole 41 formed in the center of the plate portion 44, a plurality of tongue pieces 42 which are formed so as to project from the edge of the circular hole 41 toward the center of the circular hole 41 and bent and inserted into annular recessed groove 11 of insulating body 10 (FIGS. 7 and 8), holding pieces 45AA and 45BB rearwardly bent from the upper and lower ends of front shield plate 40 so as to pinch the top and bottom surfaces of insulating body 10, a pair of engaging pieces 45A, 45B which are projecting from those holding pieces 45AA and 45BB and engaging with the recesses (not shown) formed in the top and bottom of insulating body 10 so that plate portion 44 is supported in a state in which plate portion 44 covers the front of insulating body 10, and a pair of projecting pieces 46 projected further upwardly from the upper side of plate portion 44 and have the top ends thereof forwardly bent (also refer to FIGS. 8, 9 and 10). The pair of projecting pieces 46 are utilized as contact pieces for contact with the chassis of the apparatus.

Figure 1:
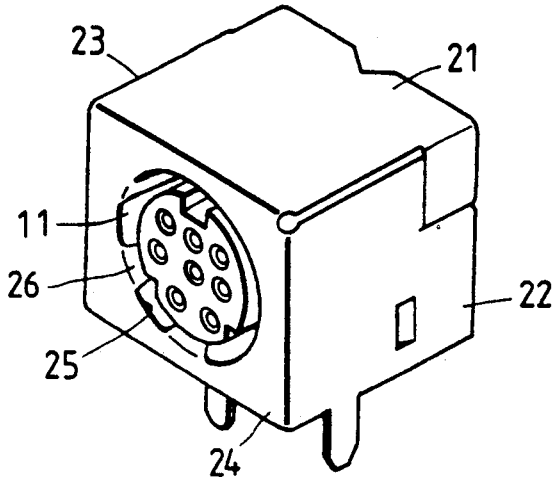
FIG. 1 PRIOR ART
FIG. 1 is a perspective view showing an example of the prior multipolar connector socket.
Figure 2:
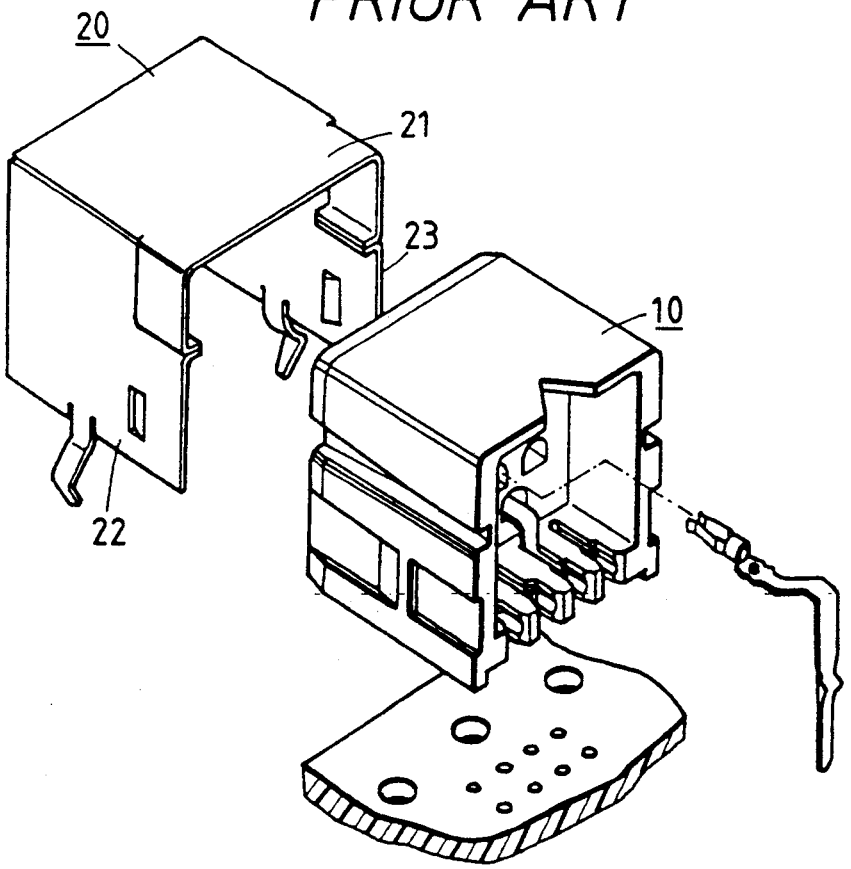
FIG. 2 PRIOR ART
FIG. 2 is an exploded perspective view of the socket of FIG. 1.
Figure 3:
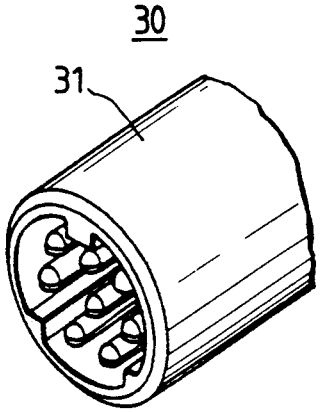
FIG. 3 PRIOR ART
FIG. 3 is a perspective view of the front end portion of the counter plug for the socket of FIG. 1.
Figure 4:
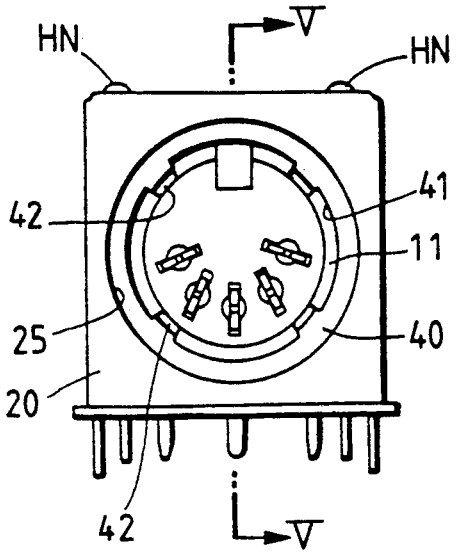
FIG. 4 PRIOR ART
FIG. 4 is a front view showing another example of the prior art.
Figure 5:
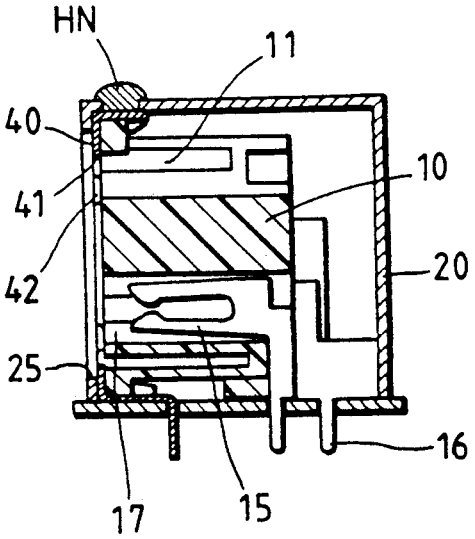
FIG. 5 PRIOR ART
FIG. 5 is a sectional view on the V—V line shown in FIG. 4.
Figure 11:
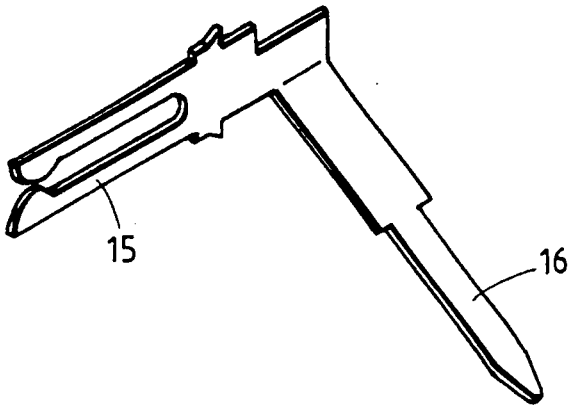
FIG. 11 is a perspective view showing an example of the structure of the contacts and terminals used in the multipolar connector socket of this invention.

Insulating body 10 may be similar to that of the prior art shown in FIGS. 1 and 2, which is substantially rectangular parallelepiped, and annular recessed groove 11 is form in the body 10 to extend rearward from the front thereof to the middle, by which column portion 10A is defined inside. In insulating body 10, for instance, flat fork-shaped female contacts 15 shown in FIG. 11 are inserted into and received in contact-receiving slots 17 formed in the body 10 to extend from the rear side of insulating body 10 shown in FIG. 12 to the vicinity of the front face of column portion 10A as sectionally shown in FIG. 13, and terminals 16 led out from the rear ends of the female contacts 15 (also see FIGS. 7, 8, etc.) are projected from the bottom of insulating body 10. In the front of column portion 10A, pin inserting holes 17A are made which are communicating with the respective contact-receiving slots 17. Terminals 16 pro-Jected from the bottom of insulating body 10 are to be inserted into the holes for parts mounting which are formed in a printed circuit board (not particularly shown) and soldered to circuit patterns in the rear of the printed circuit board.

Earth terminal 27 led out from shield cover 20 and earth terminal 47 led out from front shield plate 40 (FIG. 7 and 8) are to be connected to the earth conductor of the printed circuit board In this embodiment, projecting pieces 46 are further provided for pressure welding to the chassis or the like of the apparatus, thereby putting shield cover 20 and front shield plate 40 in electrical contact with the common earth point of the apparatus.

Figure 12:
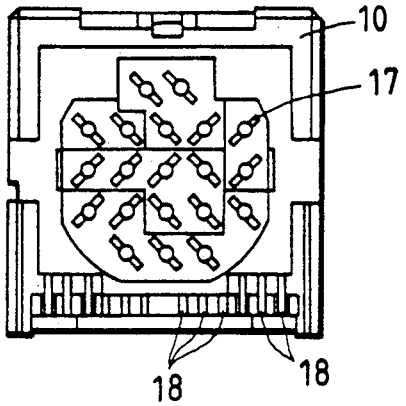
FIG. 12 is a rear view for explaining the structure of the insulating body used in the multipolar connector socket of this invention.
Figure 13:
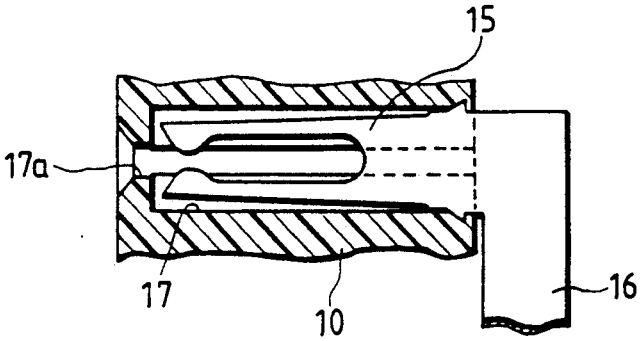
FIG. 13 is an enlarged sectional view of a female contact in the slot for receiving it which is formed in the insulating body.
Figure 14:
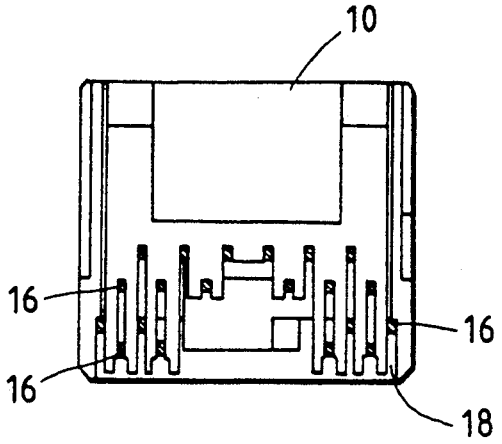
FIG. 14 is a bottom view for explaining the status of the leading-out of the terminals with the female contacts being received in the insulating body.
Figure 15:
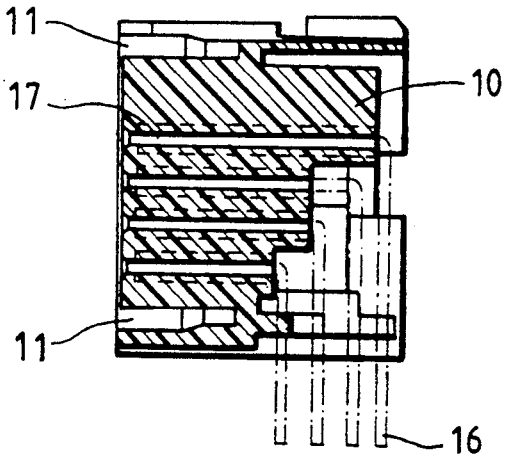
FIG. 15 is a sectional view for explaining the structure of the insulating body.

In FIGS. 12 and 13, the shape of contact-receiving slots 17 and an example of the status in which female contacts 15 are received are shown. In the embodiment shown, a 20-pin connector socket is shown. Accordingly, this example shows the case that, in order to form many closely arranged contact-receiving slots at a fixed interval in column portion 10A surrounded by annular recessed groove 11 formed in insulating body 10, almost all the contact-receiving slots 17 are inclined so that the plate surfaces of contacts 15 are inclined $\pm 45°$ with respect to the arrangement direction. On the bottom of insulating body 10, rearwardly opened cut grooves 18 are formed, and terminals 16 led out from the individual contacts 15 are press fitted into these cut grooves 18 and supported. The leading-out positions of terminals 16 are shown in FIGS. 14 and 15.

Engaging pieces 45A and 45B of front shield plate 40 (FIG. 6) engage with the recessed portions (not shown) formed in the top and bottom of insulating body 10, whereby plate portion 44 of front shield plate 40 (FIG. 6) is supported so as to cover the front face of insulating body 10. In this state, tongue pieces 42 formed on the edge of circular hole 41 extend into annular recessed groove 11 formed in insulating body 10. When cylindrical metal cover 31 of plug 30 (refer to FIG. 17) is inserted into annular recessed groove 11, tongue pieces 42 are held in elastical contact with cylindrical metal cover 31.

Insulating body 10 is covered with shield cover 20 with front shield plate 40 being attached to insulating body 10. Both side plates of shield cover 20 are provided with raises 28 (FIG. 9) which are inwardly cut and raised, and the raises 28 are engaged with recessed portions formed in insulating body 10 (for instance, the one similar to recessed portion 10D in another embodiment shown in FIG. 22), thereby preventing shield cover 20 from disengaging from insulating body 10. In this state, crests 43B (FIG. 6) in the free ends of contact pieces 43 are elastically contacted with the ceiling of shield cover 20, thereby providing electrical contact between shield cover 20 and front shield plate 40.

Figure 16:
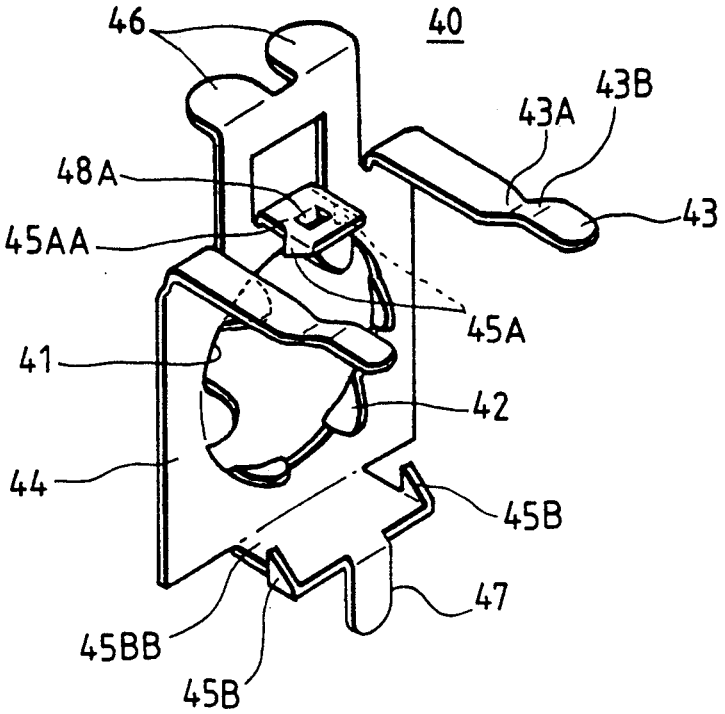
FIG. 16 is a perspective view for explaining a modification example of the front shield plate.
Figure 17:
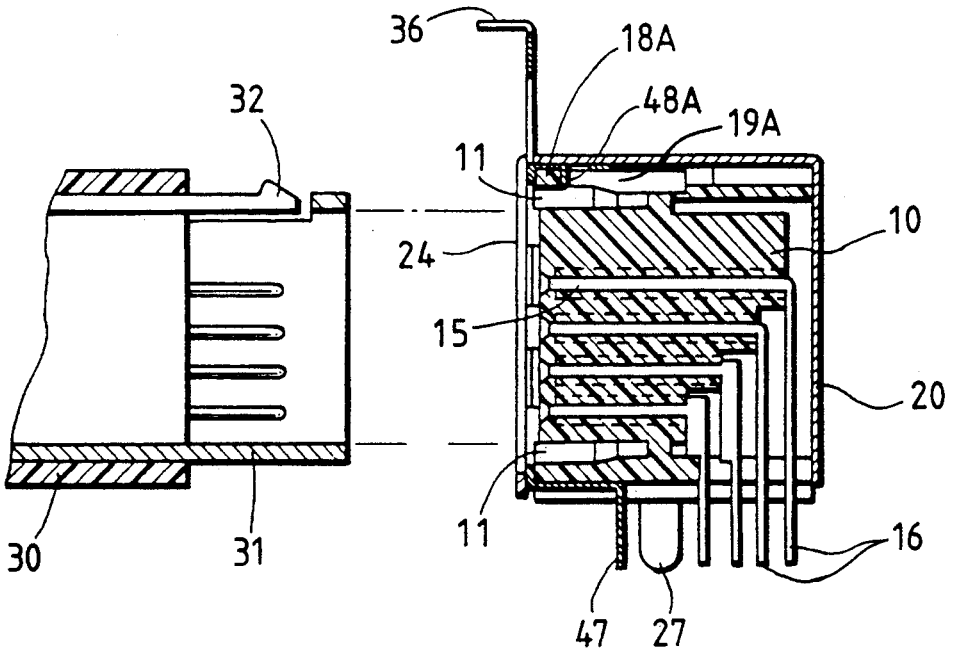
FIG. 17 is a sectional view of an embodiment of the multipolar connector socket which uses the front shield plate of FIG. 16.

FIGS. 16 and 17 show a modified embodiment of this invention. In this example, cut and raised tongue piece 48A is further formed downwardly in holding piece 45AA in which engaging pieces 45A are formed, and this tongue piece 48A is disposed along the rear of beam portion 18A (similar to beam portion 18A in FIG. 24 which is another embodiment), which is formed in the center of the upper front edge of insulating body 10 by forming communication hole 19A communicating with annular recessed groove 11 from the upper surface in the vicinity of the front surface of the insulating body. The other portions are similar to the embodiment shown in FIGS. 6–8. This modified embodiment is a socket modified correspondingly to plug 30 with a lock mechanism, and beam portion 18A is engaged with lock piece 32 provided in plug shown in FIG. 17, thereby preventing disengagement of plug 30. If tongue piece 48A is not provided, lock piece 32 directly engages with beam portion 18A when the plug 30 with a lock mechanism inserted in the socket is pulled. As a result, beam portion 18A can be worn away by abrasion with lock piece 32, or an accident can happen in which it is broken. Accordingly, if tongue piece 48A is disposed on the rear surface of beam portion 18A, beam portion 18A is not worn away when it is engaged with lock piece 32 and is reinforced against the pulling force, and the durability of beam portion 18A thus increases.

Figure 18:
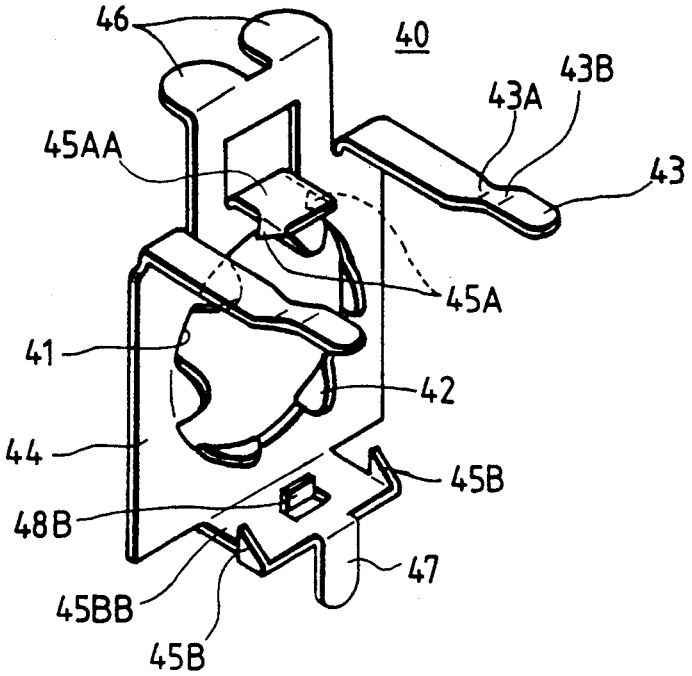
FIG. 18 is a perspective view showing another example of the front shield plate.

FIG. 18 shows another example of front shield plate 40, which shows the formation of the tongue piece on the lower side of the front shield plate 40 in conformity with the case where lock piece 32 of plug 30 engages with the beam portion provided in the lower front edge of insulating body 10 (similar to beam portion 18B in FIG. 22 which is another embodiment) That is, in this case, tongue piece 48B is provided in holding piece 45BB in which engaging pieces 45B are formed, and the rear of the beam portion formed in the bottom side of insulating body 10 can be covered by this tongue portion 48B.

Figure 19:
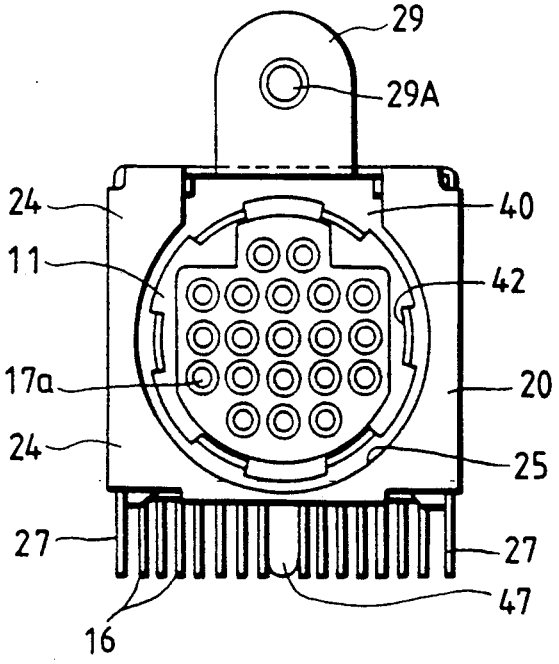
FIG. 19 is a front view showing a further example of the shield cover and front shield plate.

FIG. 19 shows another example of shield cover 20 and front shield plate 40. In this example, no projecting portion 46 is provided in front shield plate 40, instead, projecting piece 29 is formed which is cut and raised from the portion having existed in the same plane as front plate portion 24 of shield cover 20 and is upwardly projecting, and vis hole 29A is formed in this projecting piece 29, by which vis hole 29A the multiple connector socket can directly be fixed to a chassis or the like by a vis. Also in this instance, the structure of front shield plate 40 is the same as the above described embodiment in the point that contact pieces 43 are in contact with the ceiling surface of shield cover 20 within shield cover 20 to provide electrical contact between shield cover 20 and front shield plate 40.

Figure 20:
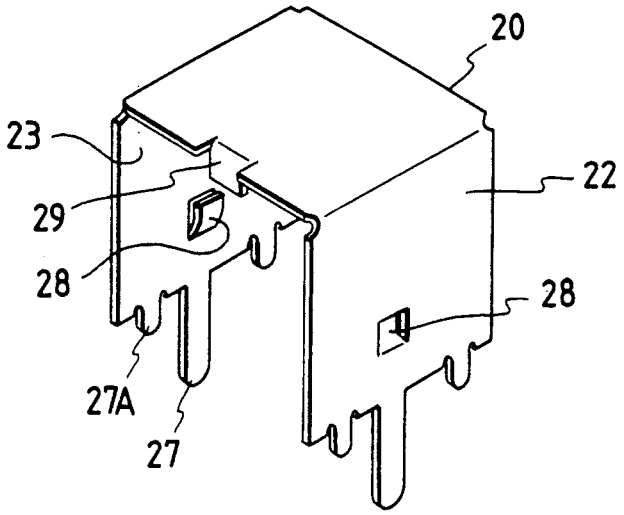
FIG. 20 is a perspective view of the shield cover used in another embodiment of the multipolar connector socket of this invention.
Figure 21:
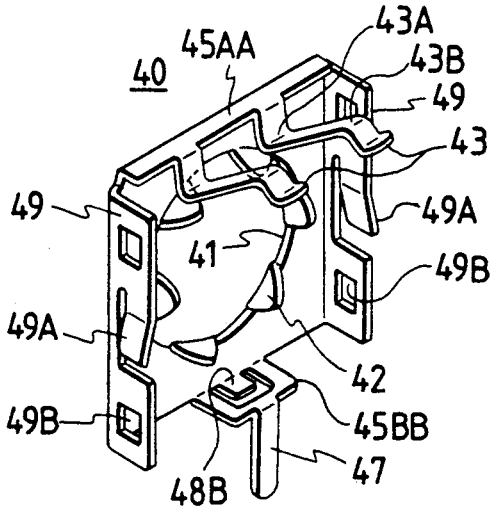
FIG. 21 is a perspective view of the front shield plate used with the shield cover of FIG. 20.
Figure 22:
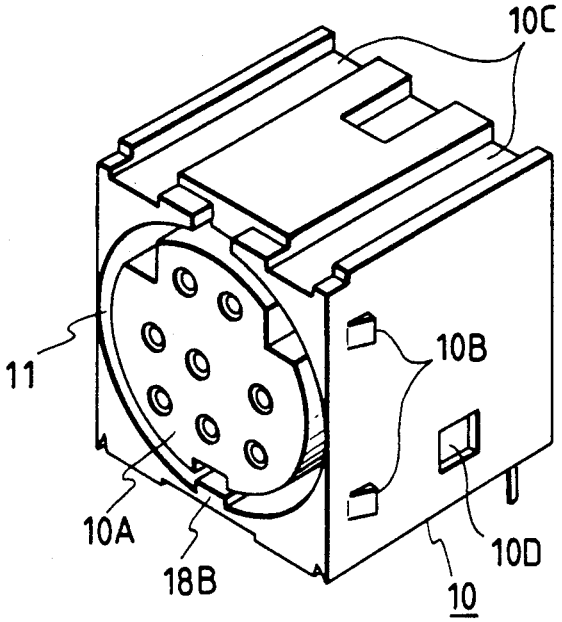
FIG. 22 is a perspective view of the insulating body used with the shield cover and shield plate of FIGS. 20 and 21.
Figure 23:
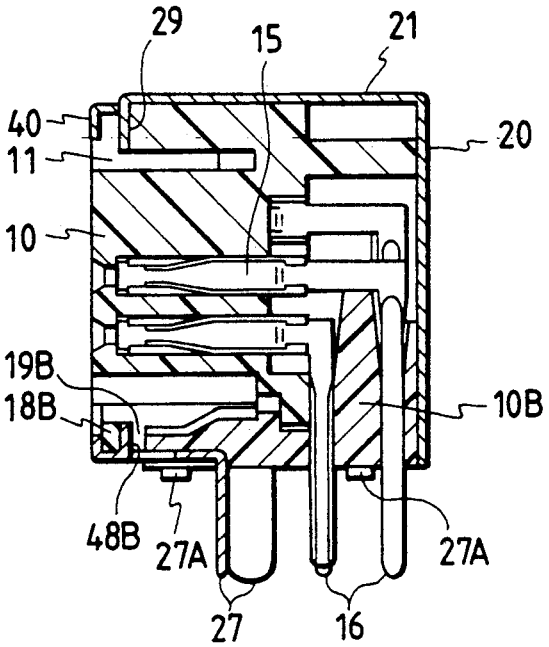
FIG. 23 is a sectional view of the same embodiment of FIGS. 20–22.

FIGS. 20 to 23 show a further embodiment of the multipolar connector socket of this invention. This embodiment is characterized in that front plate portion 24 as shown in FIG. 19 is removed from shield cover 20 and the front face of insulating body 10 is covered only with front shield plate 40. In this embodiment, in addition to upper and lower holding pieces 45AA and 45BB which are bent from the upper and lower sides of front shield plate 40 toward the top and bottom of insulating body 10 to engage with insulating body 10, thereby holding front shield plate 40 in the vertical direction with respect to insulating body 10, a pair of bent side pieces 49 bent toward both sides of insulating body 10 are also provided in both sides of front shield plate 40, thereby fixing front shield plate 40 in the horizontal direction with respect to insulating body 10 and closing gaps which would be formed between the side edges of front shield plate 40 and the front edges of side plate portions 22, 23 if bent side pieces 49 are not provided. Also in this example, a large and deep valley 43A is formed near the root of each contact piece 43 so that the length from valley 43A to crest 43B near the free end becomes longer Accordingly, crests 43B abut on the inner wall surface of shield cover 20 and are largely elastically displaced downwardly, whereby a large contact pressure can be obtained. Contact pieces 43 are received in two guide grooves 10C longitudinally formed on the upper surface of body 10 (FIG. 22).

The pair of bent side pieces 49 are provided with outwardly cut and raised contact pieces 49A, which are put in contact with the inner wall surface of shield cover 20, enhancing the electrical connection in cooperation with the electrical connection with shield cover 20 by contact pieces 43 provided on the top surface side. Moreover, engaging holes 49B are made in both bent side pieces 49 at two places, the upper and lower sides, respectively, and they engage with engaging protrusions 10B formed correspondingly to both side wall surfaces of insulating body 10 to engage front shield plate 40 with insulating body 10.

In addition, in this example, terminal holder 10E of an insulator is fitted which is separately formed in the bottom side of insulating body 10. Projecting pieces **27*a* are formed to extend downward from the bottom edges of side plate portions 22, 23 of shield cover 20 in addition to earth terminals 27 (refer to FIG. 20), and the projecting pieces 27A are bent toward the bottom of insulating body 10 to engage therewith, thereby fixing shield cover 20 to insulating body 10. Although, in this example, other publicly known female contacts different from flat forks are used as female contacts 15**, they may naturally be fork-shaped contacts.

Further, in the case where lock piece 32 of the plug with a lock mechanism (see FIG. 17) is inserted into annular recessed groove 11 at the underside of insulating body 10, communication hole 19B is formed between the front end face of terminal holder 10B and beam portion 18B in the front lower end of insulating body 10 so as to communicate with annular recessed groove 11, and cut and raised tongue piece 48B is bent to the rear side of beam portion 18B (refer to FIGS. 22 and 23), thereby preventing beam portion 18 from being worn away by lock piece 32. The structure in this respect is similar to the structure described in FIG. 18.

Figure 24:
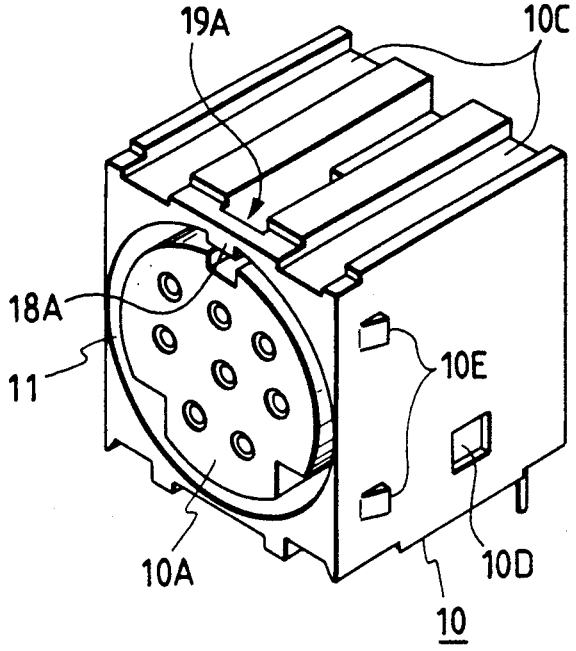
FIG. 24 is a perspective view showing a modification example of the insulating body in the embodiment of FIGS. 20–22.
Figure 25:
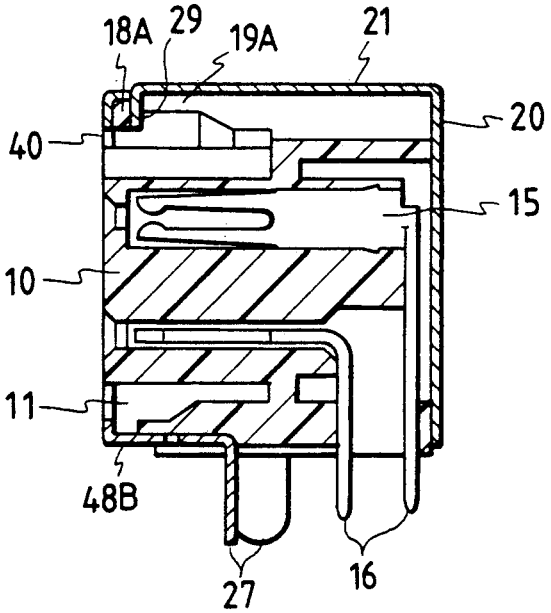
FIG. 25 is a sectional view of the socket using the body of FIG. 24.

FIGS. 24 and 25 show another embodiment of the socket constructed in combination with FIGS. 20 and 21, in which lock piece 32 of the plug shown in FIG. 17 is inserted into the upper side of annular recessed groove 11. As shown in FIG. 25, projecting piece 29 (see FIGS. 20 and 25) which is cut and raised from plate portion 21 of shield cover 20 is caused to lie along the rear of beam portion 18A, whereby beam portion 18A is protected from direct engagement with lock piece 32. On the other hand, tongue 48B is not raised and thus remains unused In addition, although the mounting structure of the contacts 15 in insulating body 10 is similar to FIGS. 8 and 13, the upper surface of insulating body 19 has guide grooves 10C formed therein for guiding largely bent contact pieces 43 (FIG. 21) as shown in FIG. 24, which is similar to the embodiment of FIG. 22.

As described above, in accordance with this invention, tongue pieces 42 to be contacted with cylindrical metal cover 31 of plug 30 are formed in front shield plate 40, and it is thus unnecessary to form shield cover 20 of a conductive spring material Accordingly, since only front shield plate 40 needs to be formed of a conductive spring material, the amount of the expensive material to be used can be decreased The cost can consequently be lowered.

In addition, since this invention is constructed such that front shield plate 40 is provided with contact pieces 43, by which shield cover 20 and front shield plate 40 are electrically contacted with each other, an advantage is obtained that a work such as soldering becomes unnecessary and the manufacturing also becomes easy.

In particular, if this invention is constructed such that cut and raised tongue piece 48A or 48B is formed in either holding piece 45AA or 45BB having engaging piece 45A or 45B, and the rear of beam portion 18A or 18B of insulating body 10 engaging with lock piece 32 of the counter-plug is protected by this cut and raised tongue piece 48A or 48B, or the rear of beam portion 18A is protected by projecting piece 29 which was cut and formed in the end portion of the upper plate of shield cover 20, then the durability of beam portion 18A or 18B constituting a lock mechanism can be increased, whereby a highly reliable connector socket with a lock mechanism can be provided.

In addition, in accordance with a further embodiment of this invention, the front of insulating body 10 is covered only with front shield plate 40, and front portion of shield cover 20 thus becomes unnecessary. The amount of the material to be used can accordingly be reduced, and the cost reduction can be expected in this point.

I claim:

1. A multipolar connector socket comprising:

A. an insulating body having a column portion surrounded by an annular recessed groove which is formed to extend rearward from a square front surface of said body female contacts received in a plurality of contact-receiving holes formed in said column portion, said insulating body having a rear surface and two sides, B. a front shield plate formed of a conductive spring material including a square plate portion for covering the front surface of said insulating body, a pair of holding means respectively extending from the upper and lower edges of said plate portion and bent toward top and bottom surfaces of said insulating body, respectively, so as to be engaged with said insulating body, thereby holding said plate portion so as to cover the front surface of the insulating body, said front shield plate having at least one contact piece extending rearward from the upper edge of said plate portion along the top surface of said insulating body, and bent so that either a crest or a valley is formed at least one place in the middle of said upper edge, a circular hole formed in said plate portion and having a diameter substantially equal to the outer circumference of the annular recessed groove formed in said insulating body, and a plurality of tongue pieces formed so as to extend rearwardly in said annular recessed groove from the peripheRal edge of said circular hole, and C. a shield cover capped over said insulating body with said front shield plate being attached to the front surface of said insulating body, and including a top plate portion, a rear plate portion and two side plate portions covering at least the top surface, rear surface and both sides of said insulating body, respectively, said crest or valley of said contact piece being sandwiched between the top surface of said insulating body and said top plate portion of said shield cover and elastically contacted with said top plate portion, whereby said front shield plate and said shield cover are electrically connected.

2. A multipolar connector socket of claim 1 wherein said shield cover has a front plate portion which covers said plate portion of said front shield plate, and a hole is formed in said front plate portion concentrically with said circular hole, said hole having a diameter equal to or slightly larger than said circular hole.

3. A multipolar connector socket of claim 1 wherein one of said pair of holding means of said front shield plate extends from substantially the center of the upper edge of said plate portion of said front shield plate, and two said contact pieces are extended at both sides of said one holding means from the upper edge of said plate portion of said front shield plate.

4. A multipolar connector socket of claim 3 wherein each of said pair of holding means has at least one engaging piece, said engaging pieces being engaged with the top and bottom surfaces of said insulating body to engage said front shield plate with said insulating body.

5. A multipolar connector socket of claim 1 wherein a communication hole communicating with said annular recessed groove is centrally formed in at least one of the bottom or top surface of said insulating body at the central in the width direction thereof and closely to the front surface of said insulating body to define a beam portion in the edge portion made by the front surface of said insulating body and one of said top and bottom surfaces, and the cut and raised tongue piece formed in one of said pair of holding means corresponding to one of said top and bottom surfaces is bent for covering and supporting the rear of said beam portion within said communication hole.

6. A multipolar connector socket of claim 1 wherein a communication hole communicating with said annular recessed groove is centrally formed in the top surface of said insulating body in the width direction thereof and closely to front surface of said insulating body to define a beam portion in the edge portion made by the front and top surfaces of said insulating body, and a cut and raised tongue piece formed in the center of the front end of the top plate portion of said shield cover is bent for covering and supporting the rear of said beam portion within said communication hole.

7. A multipolar connector socket of claim 1 wherein the front of said shield cover is opened, said plate portion of said front shield plate has bent side pieces which are extended from both sides thereof and bent so as to abut the sides of said insulating body, one of said pair of holding means has a holding piece which is extended from the upper side of said plate portion of said front shield plate and bent so as to abut the top surface of said insulating body, and there are provided two said contact pieces which are extended from the rear edge of said holding piece in parallel with each other.

8. A multipolar connector socket of claim 7 wherein each said contact piece is bent so as to form a deep valley near said holding piece and a crest near the free end thereof, and two guide grooves are formed in the top surface of said insulating body for receiving and guiding said contact pieces.

9. A multipolar connector socket of claim 7 wherein, in respective said bent side pieces and said both sides of said insulating body corresponding thereto, engaging means for engaging each other are provided, by which said front shield plate is engaged with said insulating body.

10. A multipolar connector socket of claim 1 wherein a projecting piece for attachment to a chassis is provided, which is extended from either a portion of the upper edge of said plate portion of said front shield plate or a portion of the front edge of said top plate portion of said shield cover and projecting perpendicularly to said top plate portion of said shield cover.

* * * * *